US005866521A

United States Patent [19]

Trivett

[11] Patent Number: 5,866,521

[45] Date of Patent: Feb. 2, 1999

[54] ISO-STERIC ACID-2-AMINO-2-METHYL-1-PROPANOL SALT FOR IMPROVING PETROLEUM OIL REJECTION PROPERTIES OF SYNTHETIC AND SEMI-SYNTHETIC METAL-WORKING FLUIDS

[75] Inventor: Robert L. Trivett, Aurora, Ill.

[73] Assignee: Nalco Chemical Company, Naperville, Ill.

[21] Appl. No.: 523,732

[22] Filed: Sep. 5, 1995

[51] Int. Cl.[6] ..... C10M 133/00

[52] U.S. Cl. ..... 508/411; 508/410; 508/527; 72/42

[58] Field of Search ..... 252/49.3, 51.5 R, 252/51.5 A; 554/103; 72/42; 508/527, 410, 411; C10M 129/40

[56] References Cited

U.S. PATENT DOCUMENTS

| | | | |
|---|---|---|---|
| 2,124,628 | 3/1938 | Moser . | |
| 2,151,353 | 3/1939 | Montgomery . | |
| 2,388,281 | 11/1945 | Orelup | 508/500 |
| 2,587,546 | 2/1952 | Matuszak | 508/530 |
| 3,369,930 | 2/1968 | Wojtowicz | 508/527 |
| 3,374,171 | 3/1968 | Davis . | |
| 3,657,126 | 4/1972 | Sawyer . | |
| 3,923,671 | 12/1975 | Knepp . | |
| 4,452,712 | 6/1984 | Laemmle | 508/495 |
| 5,328,630 | 7/1994 | Nozaki | 510/427 |
| 5,399,274 | 3/1995 | Marcus | 508/195 |

FOREIGN PATENT DOCUMENTS

| | | |
|---|---|---|
| 2199199 | 8/1990 | Japan . |

*Primary Examiner*—Alan Diamond
*Assistant Examiner*—Cephia D. Toomer
*Attorney, Agent, or Firm*—Thomas M. Breininger; Kelly L. Cummings; Elaine M. Ramesh

[57] ABSTRACT

The invention is for an additive composition for metal-working fluids and a method for producing the additive composition. The additive composition comprises from about 0.01 to about 25.0 mole weight of iso-stearic acid to 2-amino-2-methyl-1-propanol whereby a salt of iso-stearic acid-2-amino-2-methyl-1-propanol is formed. The metal-working fluid composition comprises from about 0.01 to about 40 percent by weight of iso-stearic acid-2-amino-2-methyl-1-propanol salt and from about 99.99 to about 60 percent by weight of a synthetic or semi-synthetic metal-working fluid.

1 Claim, 2 Drawing Sheets

ISO-STERIC ACID-2-AMINO-2-METHYL-1-PROPANOL SALT FOR IMPROVING PETROLEUM OIL REJECTION PROPERTIES OF SYNTHETIC AND SEMI-SYNTHETIC METAL-WORKING FLUIDS

FIELD OF THE INVENTION

The field of this invention is related to synthetic and semi-synthetic metal-working fluid additive compositions and more particularly to a metal-working fluid additive compositions used in metal-working operations wherein a salt is used as an emulsifier.

DESCRIPTION OF THE PRIOR ART

Metal-working operations, for example, forging, hot pressing, blanking, bending, stamping, drawing, shaping, cutting, finishing, and the like, generally use a fluid to facilitate the metal-working operation. Metal-working fluids, also referred to as metal-working lubricants, greatly improve metal-working operations in that the fluid can reduce wear on dies and tooling, as well as improving the quality of the products produced by the metal-working operations.

Common fluids, or lubricants, used in metal-working operations have included vegetable oils, animal oils, and mineral oils. It is also well known that carboxylic acids such as fatty acids can be mixed with mineral oils to produce such fluids. The Moser reference (U.S. Pat. No. 2,124,628) and the Montgomery reference (U.S. Pat. No. 2,151,353) disclose metal-working fluid formulations wherein oleic acid mixed with a mineral oil. However, these metal-working fluids were used as neat oils and not diluted by dispersion or emulsification in an aqueous medium as commonly done today.

Known metal-working fluid formulations are also known to include a dispersion of fatty acid esters and soaps in mineral oil fluids. However, these metal-working fluid formulations have proven difficult to work with in that such fluids clog filters used to remove impurities and foreign materials such as metal shavings, from the fluids. In addition, the alkaline conditions of the soaps require that the machined metal pieces be treated with an acid cleaner to remove residual metal-working fluid which results in the breakdown of the fluid.

The use of synthetic and semi-synthetic metal-working fluids have become popular over the more conventional use of petroleum based metal-working fluids. Such fluids also provide superior cooling capabilities for the tooling and workpiece versus conventional petroleum based fluids. Single phased aqueous fluids have been only marginally successful in many metal-working operations.

The Sawyer reference (U.S. Pat. No. 3,657,126) discloses an emulsifiable metal-working fluid which combines a dispersion of an aliphatc carboxylic acid glycol ester in mineral oil with an emulsifying agent to provide an emulsification or dispersion of the neat oil in an aqueous medium. The Knepp reference (U.S. Pat. No. 3,923,671) discloses a fluid containing a fatty acid and mineral oil mixed with an aliphatic carboxylic acid ester and an emulsifier. It is also known that aqueous fluid compositions can be formulated using alkanolamines and polyoxyalkylene glycols. The Davis reference (U.S. Pat. No. 3,374,171) discloses a cutting fluid formulated by mixing an alkanolamine, a polyoxyalkylene glycol and a saturated organic acid containing from 6 to 9 carbon atoms. However, these formulations have not been effective in some metal-working operations.

Residual oils, also referred to as tramp oil, are often present on the surfaces of bar stock, sheet metal, and castings machined by various metal-working operations. These oils may also be present as the result of earlier metal-working or fabrication operations as well as other petroleum oils, including hydraulic and mechanical oils, that have leaked from the various machines used in the handling and machining of the products.

The residual oils become mixed with the metal-working fluid. Many of the metal-working fluid compositions taught in the prior art are not compatible with such residual oils. The mixing of the residual oils and the metal-working fluid results in a contamination type effect which renders the fluid unreusable without further processing. Such contamination can drastically affect metal-working fluid performance by degrading the chemical and physical properties of the fluid. Biostability is often affected. These residual oils become emulsified into the metal-working fluid during metal-working operations. The emulsified residual oils becomes a nutrient source for certain species of bacteria and fungi. Microbiological contamination can quickly degrade a metal-working fluid by decreasing pH and contaminating the fluid with organic by-products. This can lead to poor lubrication, corrosion problems or dermatitis among workers exposed to the fluid. Besides the increased costs of using large quantities of metal-working fluids, such contamination results in a disposal problem of the residual oils contained in the spent fluids as well as the disposal of the spent fluids themselves.

In addition, metal-working operations generally result in the exposure of unprotected metal surfaces to the atmosphere and other corrosive influences leaving the metal pieces susceptible to corrosion. As such, corrosion inhibitors are often added to metal-working fluids. Other treatment agents which improve the treatability, biostability and handling properties of the metal-working fluid are also frequently added to the fluid. Treatability refers to the properties of the fluid to be conditioned for re-use or treated for disposal. Biostability refers to the properties of the fluid to remain stable in the presence of different contaminants and impurities.

It would be desirable to provide an additive for a metal-working lubricants that would provide improved residual oils rejection properties whereby the fluid would not be contaminated by the presence of the residual oils. It would also be desirable to provide an additive for metal-working fluids wherein the biostability, treatability and lubrication qualities of the treated fluid would not be affected or would be enhanced by the presence of the additive. It would also be desirable that the additive would not be negatively affected by the presence of other treatment agents, such as corrosion inhibitors, that may be present in the fluid or the metal-working operations.

SUMMARY OF THE INVENTION

The invention is for an additive composition for metal-working fluids and a method for producing the additive. The additive composition comprises from about 0.01 to about 25.0, more preferably from about 0.1 to about 10.0, and most preferably from about 1.0 to about 3.2, mole weight of iso-stearic acid to 2-amino-2-methyl-1-propanol whereby the salt of iso-stearic acid and 2-amino-2-methyl-1-propanol (iso-stearic acid-2-amino-2-methyl-1-propanol salt) is formed. The additive composition acts as a primary emulsifier and improves tramp oils rejection from the metal-working fluids.

The additive composition comprises from about 0.01 to about 40.0 percent by weight of iso-stearic acid-2-amino-2-methyl-1-propanol salt which is incorporated into a synthetic or semi-synthetic metalworking fluid.

DESCRIPTION OF THE INVENTION

Figure 1:
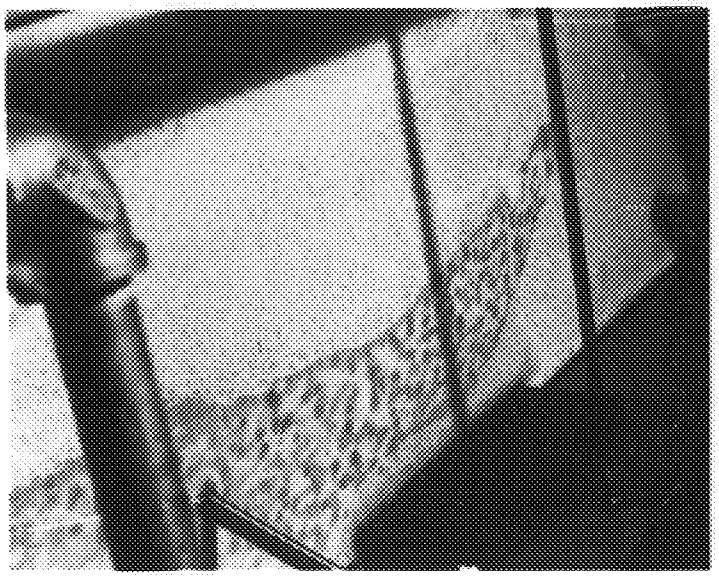
FIG. 1 Photograph of tramp oils present on surface of metal-working fluid.

The invention is for an additive composition for metal-working fluids, the additive composition comprising a salt of iso-stearic acid and amino-2-methyl-1-propanol (iso-stearic acid-2-amino-2-methyl-1-propanol salt). The mole ratio of iso-stearic acid to 2-amino-2-methyl-1-propanol is preferably from about 0.01 to about 25.0, and more preferably from about 0.1 to about 10.0 and most preferably from about 1.0 to about 3.2 wherein the additive composition acts as a primary emulsifier and improves tramp oils rejection from the metal-working fluids.

The metal-working fluid composition containing the additive composition comprises from about 0.01 to about 40.0 percent by weight of the iso-stearic acid-2-amino-2-methyl-1-propanol salt and from about 99.99 to about 60.0 percent by weight of a synthetic or semi-synthetic metal-working fluid. The weight of the iso-stearic acid-2-amino-2-methyl-1-propanol salt in the metal-working fluid is more preferably from about 0.5 to about 20.0 percent and more preferably from about 0.5 to about 10.0 percent.

Another embodiment of the invention is for a method whereby the additive composition for metal-working fluids is produced. The method comprises adding from about 50.0 to about 60.0 percent by weight of water to a water-phase blender, agitating the water in the blender and heating the water to a temperature ranging from about 150° to about 160° F. From about 15.0 to about 30.0 percent by weight of naphthenic petroleum hydrocarbon oil is added to an oil-phase blender, agitating and heating the distillates to a temperature ranging from about 150° to about 160° F. The additional advantage offered by this method is that the formation of the iso-stearic acid-2-amino-2-methyl-1-propanol salt can take place as part of the general manufacturing procedure for the semi-synthetic metalworking fluids. The salt does not have to be formed separately and then added.

From about 1.0 to about 5.0 percent by weight of sodium petroleum sulfonate, from about 5.0 to about 15.0 percent by weight of tall oil fatty acid diethanol amide and from about 0.01 to about 16.0 percent by weight of iso-stearic acid is added to the oil-phase blender and mixing the resulting solution until all solids are dissolved. The most preferred iso-stearic acid would be Century 1105 or Century 1110 (commercially available from the Union Camp Corporation) having an acid value range of from about 178 to about 200, a saponification value range of from about 187 to about 202, a titer point range of from about 7° to about 14° C. and an iodine value range of from about 1.0 to about 10.0.

After the water in the water-phase blender has reached a temperature ranging from about 150° to about 160° F., from about 0.01 to about 5.0 percent by weight of 2-amino-2-methyl-1-propanol is added to the water-phase blender and mixing the resulting solution until all solids are dissolved. The most preferred 2-amino-2-methyl-1-propanol is AMP-95 (commercially available from the Angus Corporation). From about 0.01 to about 5.0 percent by weight of pentylethanol amine is added to the water-phase blender while continuing to mix until the resulting solution is homogenous.

The contents of the oil-phase blender is added to the water-phase blender whereby an invert water-in-oil emulsion is formed. As the oil-phase is added to the water-phase, the iso-stearic acid is neutralized by the 2-amino-2-methyl-1-propanol present in the aqueous blend. This neutralization allows the water-phase to become emulsified, forming the internal or discontinuous phase of an invert water-in-oil emulsion. The oil-phase functions as the external or continuous phase of the emulsion. From about 0.01 to about 1.0 percent by weight of sodium pyrithione is then added to the emulsion. The emulsion, the iso-stearic acid-2-amino-2-methyl-1-propanol salt, is cooled to a temperature ranging from about 100° to about 110° F. while continuing to mix the emulsion. The resulting fluid is a dark, clear amber inverted water-in-oil emulsion. When utilized in the field as a metalworking fluid, the water-in-oil emulsion is diluted with water to form an oil-in-water emulsion. The water-in-oil emulsion inverts to become an oil-in-water emulsion for metalworking applications. The iso-stearic acid-2-amino-2-methyl-1-propanol salt exhibits flexible versatility as a primary emulsifier for both types of emulsion systems.

The metal-working fluid samples treated with the additive demonstrated comparable lubrication, corrosion protection, biostability or treatability properties when compared to untreated metal-working fluid samples. The lubricosity and biostability properties of the treated fluid were at least as good as the untreated fluid. In addition, the treatability property of the treated fluid was vastly improved over the untreated fluid. The claimed additive can be used with fluids in metal-working operations carried out on ferrous and non-ferrous metals. In addition, the claimed additive is compatible with treatment agents including corrosion inhibitors and biocides.

The residual oils rejected by the additive in the metal-working fluid may be removed by a skimmer, centrifuge or any other method by which different liquids can be separated. This provides environmental as well as cost benefits. Because untreated spent metal-working fluid contains residual oils, both the fluid and residual oils must be handled and disposed of as contaminated oil. However, the treated metal-working fluid can be used longer before it must be replaced. Once the treated fluid is spent, it can be more easily disposed of because it contains only minimal residual oil contaminants. The recovered residual oils can be separately handled or disposed of according to governmental regulations rather than handling or disposing of the metal-working fluid and residual oils according to such regulations.

The following examples are presented to describe preferred embodiments and utilities of the invention and are not meant to limit the invention unless otherwise stated in the claims appended hereto.

EXAMPLE 1

Performance tests were conducted, comparing a semi-synthetic metalworking fluid using a tall oil derived oleic fatty acid salt as an emulsifier to a metal-working fluid using the iso-stearic acid-2-amino-2-methyl-1-propanol salt as the primary emulsifier. Tall oil derived fatty acid systems have been utilized for years as common emulsifiers for metal-working fluids. Several different types of water were used in these tests. The four oils utilized for the residual oils rejection studies were commercial hydraulic and machining oils obtained from a Midwest automotive parts manufacturing plant.

The four metal-working fluid products are a spindle lubricant oil, two hydraulic oils and a sulfurized (2%) grinding oil. All four products are based on naphthenic petroleum hydrocarbon oils and vary in viscosity between about 50 and about 200 SUS (100° F.). All four oils can routinely leak into a metalworking fluid system. The blend utilized for residual oils rejection test A was based on plant average values over the past two years.

The tests show that the salt formulation exhibits exceptional oil rejection characteristics for a wide variety of residual oils even where the water hardness was increased in comparison to the tall oil fatty acid salt formulation. The iso-stearic acid-2-amino-2-methyl-1-propanol salt formulation exhibited rejection rates of only 35 seconds versus 300 seconds for the control formulation based upon the tall oil fatty acid salt. The iso-stearic acid-2-amino-2-methyl-1-propanol salt dramatically improved the rejection rates for the oil mixture. In addition, the emulsions were significantly cleaner in appearance (homogenous oil layer, distinct oil-water interface, and clearer aqueous layer). The iso-stearic acid-2-amino-2-methyl-1-propanol salt also exhibited superior rejection rates for the Shell T-68 hydraulic oil with 100% rejection within 60 seconds versus only a 30–35% rejection after 5 minutes for the tall oil fatty acid formulation.

In addition, emulsion stability, corrosion protection and anti-foaming tendencies remained comparable with the lubricant using a tall oil fatty acid as an emulsifier. Grinding evaluations revealed that the salt improved grinding lubrication on the ferrous alloy as revealed through decreased block weight loss. See Table 1. The iso-stearic acid-2-amino-2-methyl-1-propanol salt formulation exhibited an 11.0% decrease in block weight loss for the Temken grinding evaluation when compared to the results using the tall oil fatty acid formulation.

TABLE 1

Performance Properties and Typical Formulation Results
Tall Oil Fatty Acid Salt Versus Iso-Stearic Acid-2-Amino-2-Methyl-1-Propanol Salt

| Parameter | Tall Oil Fatty Acid Salt | Iso-Stearic Acid-2-Amino-2-Methyl-1-Propanol Salt |
|---|---|---|
| Appearance | | |
| Concentrate | Amber, clear fluid | Amber, clear fluid |
| Dilution (7% in 100 ppm hardness water) | Opaque solution | Opaque solution |
| Residue (24 hr. at 25° C.) | Light fluid film; homogenous coverage; easily remixes in water | Light fluid film; homogenous coverage; easily remixes in water |
| Foam Test (20/1 dilution: 5 min. at 25° C. in 100 ppm hardness water) | No foam | 50 mL of foam; break in 60 sec. |
| Cast Iron Chip Corrosion: 48 hr. at 25° C. ASTM D4627-92 | Pass 10/1–50/1 in Chicago tap water: chips loose | Pass 10/1–50/1 in Chicago tap water: chips loose |
| High Temperature Stability (3 cycles; each cycle 24 hr. at 71° C., then 24 hr. at 25° C.) | Clear and stable | Clear and stable |
| Tramp Oil Rejection | | |
| A. Mixture (50% spindle oil, 30% L10 hydraulic oil and 20% grinding oil): 3% oil | 100% rejection within five min. at both temperatures | 100% rejection within 35–45 sec. at both temperatures |
| B. Shell Tonnia T-68: 3% oil (All tests run at both 25° C. and 43° C. 7% emulsions in 100 ppm hardness water. Five minutes of moderate agitation.) | 30 to 35% rejection within five min. at both temperatures | 100% rejection within 60 sec. at both temperatures |
| Dilution Stability (5% dilutions at 25° C. for 48 hrs.) | | |
| A. Chicago Tap Water | Stable | Stable |
| B. Deionized Water | Stable | Stable |
| C. 100 ppm Hardness water | Stable | Stable |
| D. 250 ppm Hardness Water | Stable | Stable |
| E. 400 ppm Hardness Water | Stable | Stable |
| Lubrication Evaluation (5% dilution in Chicago Tap Water) ASTM D3233-86 | | |
| Pass Load (lb) | 4500 | 4500 |
| Failure Load (lb) | No failure | No failure |
| Torque (lb) | 69.0 | 62.0 |
| Percent Pin Weight Loss | 0.16% | 0.18% |
| Timken Steel Grinding Evaluation (7% dilution in 100 ppm hardness water): 1070 steel blocks | | |

TABLE 1-continued

Performance Properties and Typical Formulation Results
Tall Oil Fatty Acid Salt Versus Iso-Stearic Acid-2-Amino-2-Methyl-1-Propanol Salt

| Parameter | Tall Oil Fatty Acid Salt | Iso-Stearic Acid-2-Amino-2-Methyl-1-Propanol Salt |
|---|---|---|
| ASTM D2782-88 | | |
| 15 min. at 15 lb.<br>20 min. at 25 lb.<br>25 min. at 30 lb. | 8.14% block weight loss: polished surface | 7.24% block weight loss: polished surface |

EXAMPLE 2

Simulator studies were conducted, comparing a semi-synthetic metalworking fluid using a tall oil derived oleic fatty acid salt as an emulsifier to a metal-working fluid using the iso-stearic acid-2-amino-2-methyl-1-propanol salt as the primary emulsifier. The two fluids were used in similar metal-working operations for a total of 16 hours over a two day period. Sixteen gallons of metalworking fluid are recirculated in a fluid simulator designed to duplicate manufacturing conditions wherein a metalworking fluid would be exposed to constant agitation from continuous pumping from a central tank to machining site and back to the tank. In addition, this recirculation also exposes the fluid to continuous shear which can alter the particle size of the emulsion and help disperse the residual oils by reducing the particle size of the residual oils. This reduction in particle size allows the oil droplets to become more easily entrapped (physically and chemically) within the metalworking fluid. Emulsions were maintained at about a 6% concentration in 100 ppm hardness water. The emulsions were contaminated with about 4% by volume of a hydraulic oil mixture utilized in the Example 1 evaluations. The fluids were tested at the end of eight and sixteen hours.

The metal-working fluid containing the iso-stearic acid-2-amino-2-methyl-1-propanol salt offered improved residual oils rejection and exhibited smaller decreases in pH values and only minor changes in average cumulative emulsion particle size as determined by the Coulter Counter. The iso-stearic acid-2-amino-2-methyl-1-propanol salt emulsion exhibited a particle size increase of only 5% (from about 8.0 to about 8.4 microns) over the sixteen hour test cycle. In contrast, the tall oil fatty acid emulsion exhibited a particle size increase of 13.9% (from about 7.9 to about 9.0 microns).

The fluids also exhibited dramatic differences in oil rejection capabilities with the iso-stearic acid-2-amino-2-methyl-1-propanol salt emulsion exhibiting a heavy and continuous oil film across the surface of the emulsion. The rejected oils can easily be removed from a process tank by skimming devices or by other methods. The tall oil fatty acid system exhibited a splotchy and discontinuous oil film across the surface of its emulsion.

Figure 2:
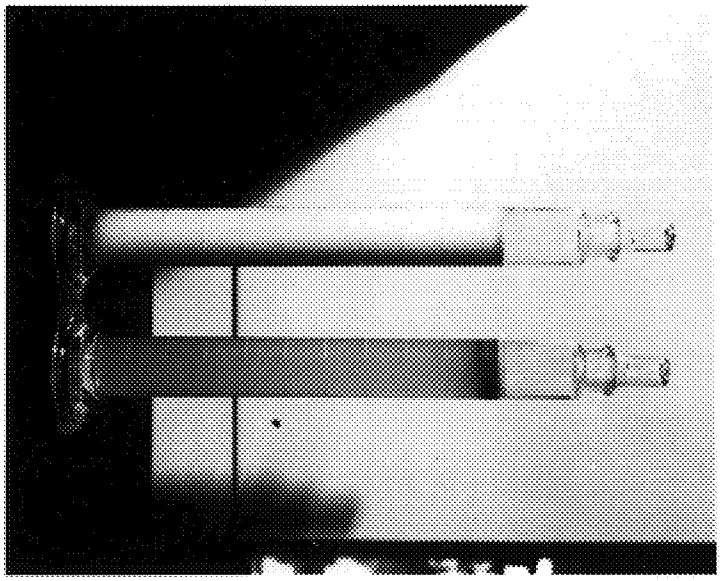
FIG. 2 Photograph of graduated cylinders comparing the tramp oils rejection of treated and untreated metal-working fluids.

The metal-working fluid using the iso-stearic acid-2-amino-2-methyl-1-propanol salt as the primary emulsifier also exhibited less organic build up (oil retention) than did the standard metal-working fluid in which a tall oil fatty acid was used as an emulsifier. This cleaner surface is due to both lower levels of emulsified residual oils in the circulating fluid (residual oils are being rejected better and floating on surface of emulsion) and better emulsion stability. Improved emulsion stability results in reduced organic component breakdown from the fluid components which could then become contaminants. Lower organic contamination will also reduce the likelihood for attracting swarf (metallic fines), dirt or other contaminants to the metal surfaces present in the system. The iso-stearic acid-2-amino-2-methyl-1-propanol salt formulation rejected residual oils better, entrapped less dirt and oil as evident in FIGS. 1 and 2.

TABLE 2

Simulator Studies
Results (Two-Day Run for 16 hours: 6% Concentration-4% Oil)

| Parameter | Tall Oil Fatty Acid Salt | Iso-Stearic-2-Amino-2-Methyl-1-Propanol Salt |
|---|---|---|
| DAY ONE | | |
| Start | Tan, opaque emulsion with pH of 9.8, R.I. of 1.3370, particle size of 7.9$\mu$ and heavy surface oil. | Tan, clear emulsion with pH of 9.85, R.I. of 1.3375, particle size of 8.0$\mu$ and heavy surface oil. |
| Completion | Tan, opaque emulsion with pH of 9.7, R.I. of 1.3373, particle size of 8.5$\mu$ and moderate surface oil (milky appearance) | Tan, opaque emulsion with pH of 9.80, R.I. of 1.3375, particle size of 8.2$\mu$ and heavy surface oil (continuous oil film) |
| DAY TWO | | |
| Start | Tan, opaque emulsion (milky appearance with pH of 9.65, R.I. of 1.3374, particle size of 8.8$\mu$ and moderate surface oil (splotchy surface distribution with cloudy appearance). | Tan, opaque emulsion with pH of 9.80, R.I. of 1.3375, particle size of 8.2$\mu$ and heavy surface oil (continuous oil film) |
| Completion | Tan, opaque emulsion (milky | Tan, opaque emulsion with pH of |

TABLE 2-continued

| Simulator Studies Results (Two-Day Run for 16 hours: 6% Concentration-4% Oil) | | |
|---|---|---|
| Parameter | Tall Oil Fatty Acid Salt | Iso-Stearic-2-Amino-2-Methyl-1-Propanol Salt |
| DAY ONE | | |
| | appearance) with pH of 9.60, R.I. of 1.3375, particle size of 9.0$\mu$ and mild surface oil (splotchy surface) | 9.75, R.I. of 1.3375, particle size of 8.4$\mu$ and heavy surface oil (continuous oil film) |
| Steel Test panel Surface Deposits (16 hours) | Moderate organic buildup with tacky film characteristics | Light organic buildup with oily film characteristics |

Changes can be made in the composition, operation and arrangement of the method of the present invention described herein without departing from the concept and scope of the invention as defined in the following claims:

I claim:

1. A method for producing an additive composition for metal-working fluids comprising:

a. adding from about 50.0 to about 60.0 percent by weight of water to a water-phase blender, agitating the water in the blender and heating the water to a temperature ranging from about 150° to about 160° F.;

b. adding from about 15.0 to about 30.0 percent by weight of naphthenic petroleum hydrocarbon oil to a oil-phase blender, agitating the oil in the blender and heating the oil to a temperature ranging from about 150° to about 160° F.;

c. adding from about 1.0 to about 5.0 percent by weight of sodium petroleum sulfonate, from about 5.0 to about 15.0 percent by weight of fatty acid diethanol amide and from about 0.01 to about 16.0 percent by weight of iso-stearic acid to the oil-phase blender and mixing until all solids are dissolved;

d. after the water in the water-phase blender has reached a temperature ranging from about 150° to about 160° F., adding from about 0.01 to about 5.0 percent by weight of 2-amino-2-methyl-1-propanol and mixing until all solids are dissolved;

e. adding from about 0.01 to about 5.0 percent by weight of pentylethanol amine to the water-phase blender and mixing until the resulting solution is homogenous;

f. adding the contents of the oil-phase blender to the water-phase blender whereby an emulsion of iso-stearic acid-2-amino-2-methyl-1-propanol salt is formed; and, g. adding from about 0.01 to about 1.0 percent by weight of sodium pyrithione to the emulsion and cooling the emulsion to a temperature ranging from about 100° to about 110° F. while continuing to mix the emulsion.

* * * * *